US010653931B2

(12) United States Patent
Philip et al.

(10) Patent No.: US 10,653,931 B2
(45) **Date of Patent: *May 19, 2020**

(54) GROOVE PATTERN FOR A PUTTER HEAD

(71) Applicant: Tru2Sports LLC, Dallas, TX (US)

(72) Inventors: Blair M. Philip, Dallas, TX (US); Jeffrey T. Halstead, Wylie, TX (US)

(73) Assignee: Tru2Sports LLC, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/874,776

(22) Filed: Jan. 18, 2018

(65) Prior Publication Data

US 2018/0140912 A1 May 24, 2018

Related U.S. Application Data

(63) Continuation of application No. 15/292,412, filed on Oct. 13, 2016, now Pat. No. 9,889,353.

(60) Provisional application No. 62/247,688, filed on Oct. 28, 2015, provisional application No. 62/326,247, filed on Apr. 22, 2016.

(51) Int. Cl.
*A63B 53/04* (2015.01)

(52) U.S. Cl.
CPC .... *A63B 53/0487* (2013.01); *A63B 2053/042* (2013.01); *A63B 2053/0408* (2013.01); *A63B 2053/0445* (2013.01)

(58) Field of Classification Search
CPC ..... A63B 53/0487; A63B 2053/0408; A63B 2053/042
USPC ..... 473/330, 331
See application file for complete search history.

(56) References Cited

U.S. PATENT DOCUMENTS

| | | | | |
|---|---|---|---|---|
| 5,531,439 | A | 7/1996 | Azzarella | |
| 5,618,239 | A * | 4/1997 | Rife | A63B 53/0487 473/330 |
| 5,688,186 | A | 11/1997 | Michaels et al. | |
| 5,709,616 | A | 1/1998 | Rife et al. | |
| 5,766,087 | A | 6/1998 | Kawamatsu | |
| 6,183,379 | B1 | 2/2001 | Kim et al. | |
| 6,302,807 | B1 | 10/2001 | Rohrer | |
| 6,554,721 | B1 | 4/2003 | Woodward et al. | |
| 7,278,926 | B2 | 10/2007 | Frame | |
| 7,815,521 | B2 | 10/2010 | Ban et al. | |
| 7,922,602 | B2 | 4/2011 | Johnson | |
| 8,066,587 | B2 | 11/2011 | Tateno et al. | |
| 8,216,081 | B2 | 7/2012 | Snyder et al. | |
| 8,287,401 | B2 | 10/2012 | Tateno et al. | |
| 8,491,415 | B2 | 7/2013 | Ishikawa et al. | |
| 8,506,415 | B2 | 8/2013 | Franklin | |
| 8,523,703 | B2 | 9/2013 | Rife | |
| 8,622,850 | B2 | 1/2014 | Narita et al. | |
| 8,753,223 | B2 | 6/2014 | Stites | |
| 8,790,193 | B2 * | 7/2014 | Serrano | A63B 53/0487 473/331 |
| 8,840,488 | B2 | 9/2014 | Evans | |

(Continued)

*Primary Examiner* — Michael D Dennis
(74) *Attorney, Agent, or Firm* — Dorsey & Whitney LLP

(57) ABSTRACT

A putter head is provided. The putter head includes a putter face defining a groove pattern extending in a heel-to-toe direction of the putter face. The groove pattern includes multiple sets of grooves spaced apart from one another in a vertical direction of the putter face. The sets of grooves have different cross-sectional configurations to adjust a launch angle of a golf ball based on an impact location of the golf ball along the vertical direction of the putter face.

14 Claims, 13 Drawing Sheets

(56) References Cited

U.S. PATENT DOCUMENTS

| | | | | |
|---|---|---|---|---|
| 8,979,667 | B1 | 3/2015 | Tipton | |
| 2003/0008724 | A1 | 1/2003 | Griffin | |
| 2004/0038747 | A1 | 2/2004 | Lindsay | |
| 2005/0009623 | A1 | 1/2005 | Dickinson | |
| 2005/0209020 | A1* | 9/2005 | Burrows ..... | A63B 53/0487 473/330 |
| 2007/0082752 | A1 | 4/2007 | Boyd | |
| 2009/0156328 | A1 | 6/2009 | Reese | |
| 2009/0291773 | A1 | 11/2009 | De La Cruz et al. | |
| 2011/0172026 | A1 | 7/2011 | Cackett et al. | |
| 2012/0135819 | A1 | 5/2012 | Uetz et al. | |
| 2013/0331197 | A1 | 12/2013 | Hackenberg | |
| 2014/0155191 | A1 | 6/2014 | Brandt | |
| 2017/0120115 | A1 | 5/2017 | Philip et al. | |

* cited by examiner

GROOVE PATTERN FOR A PUTTER HEAD

CROSS-REFERENCE TO RELATED APPLICATIONS

This application is a continuation of U.S. patent application Ser. No. 15/292,412, filed Oct. 13, 2016, and entitled "Groove Pattern for a Putter Head," which claims the benefit of priority under 35 U.S.C. § 119(e) of U.S. provisional patent application Ser. No. 62/247,688, filed Oct. 28, 2015, and entitled "Groove Pattern for a Putter Head," and of U.S. provisional patent application Ser. No. 62/326,247, filed Apr. 22, 2016, and entitled "Groove Pattern for a Putter Head," which are hereby incorporated herein in their entireties.

FIELD

The present disclosure relates generally to golf clubs, and more particularly to a groove pattern for a putter head.

BACKGROUND

Generally, when a golfer putts a ball, it initially skids along the ground before it begins to roll in a forward direction. Minimizing the amount of skid increases the golfer's control of the ball. The quicker the ball achieves true forward roll or rotation (the moment that the ball achieves forward or over spin without skidding or retaining backspin), the more control the golfer has over the distance and the path the golf ball travels along the green surface.

When a golf ball is struck by a putter head at a bottom of the golfer's swing, generally the static loft of the putter face lifts the ball out of a small depression in the green surface caused by the ball, and the ball reaches a forward roll quickly along the green surface. However, golfers typically are not consistent in their swing, which generally reduces the control the golfer has over the distance and the path the golf ball travels along the green surface. For example, if a golf ball is struck by a putter during an upward motion of the putter head, the putter head typically launches the ball off the ground, and the ball bounces and/or skids when it hits the green surface, thereby reducing a golfer's control over the distance and the path of the putt. Alternatively, if a golf ball is struck by a putter during a downward motion of the putter head, the putter head typically drives the ball into the ground, causing the ball to bounce and/or skid, thereby reducing a golfer's control over the distance and the path of the putt. For at least these reasons, it is difficult to fit a particular golfer with a putter.

SUMMARY

Embodiments of the disclosure generally provide a putter head that improves accuracy and consistency of putts, regardless of variations in a golfer's swing. The putter head includes a putter face defining a groove pattern extending in a heel-to-toe direction of the putter face. The groove pattern includes multiple sets, regions, or zones of grooves spaced apart from one another in a vertical direction of the putter face. The sets of grooves have different cross-sectional configurations to adjust a launch angle of a golf ball based on an impact location of the golf ball along the vertical direction of the putter face.

In some embodiments, the putter head includes a putter face defining a first set of grooves and a second set of grooves extending in a heel-to-toe direction of the putter head. The second set of grooves may be positioned apart from the first set of grooves in the vertical direction of the putter face. The first and second sets of grooves may have different cross-sectional configurations. The putter head may include a third set of grooves extending in the heel-to-toe direction and positioned apart from the first and second sets of grooves in the vertical direction of the putter face. Each groove of the first and third sets of grooves may have a non-symmetrical cross-sectional configuration, whereas each groove of the second set of grooves may have a symmetrical cross-sectional configuration.

This summary of the disclosure is given to aid understanding, and one of skill in the art will understand that each of the various aspects and features of the disclosure may advantageously be used separately in some instances, or in combination with other aspects and features of the disclosure in other instances. Accordingly, while the disclosure is presented in terms of embodiments, it should be appreciated that individual aspects of any embodiment can be claimed separately or in combination with aspects and features of that embodiment or any other embodiment.

The present disclosure is set forth in various levels of detail in this application and no limitation as to the scope of the claimed subject matter is intended by either the inclusion or non-inclusion of elements, components, or the like in this summary. In certain instances, details that are not necessary for an understanding of the disclosure or that render other details difficult to perceive may have been omitted. It should be understood that the claimed subject matter is not necessarily limited to the particular embodiments or arrangements illustrated herein.

BRIEF DESCRIPTION OF THE DRAWINGS

The accompanying drawings, which are incorporated into and constitute a part of the specification, illustrate embodiments of the disclosure and, together with the general description given above and the detailed description given below, serve to explain the principles of these embodiments.

DETAILED DESCRIPTION

Embodiments of the present disclosure generally provide a putter head including grooves located in different regions on a putter face for improving the accuracy and consistency of putts, regardless of variations in the golfer's swing. The applicant uses the term "groove" in this description broadly to include cuts, crevices, depressions, recesses, troughs, or other voids that are associated with a putter face. In a preferred embodiment, the grooves are substantially parallel to one another and are arranged generally horizontally in a heel-to-toe direction on the putter face.

An example embodiment of a putter head is shown and described below with respect to FIGS. 1-11. Although in each of these figures the putter head is shown with three regions of grooves, the putter head may include two, three, or more regions of grooves. The grooves may be used with any type of putter head or shaft, whether currently known or later developed.

Figure 1:
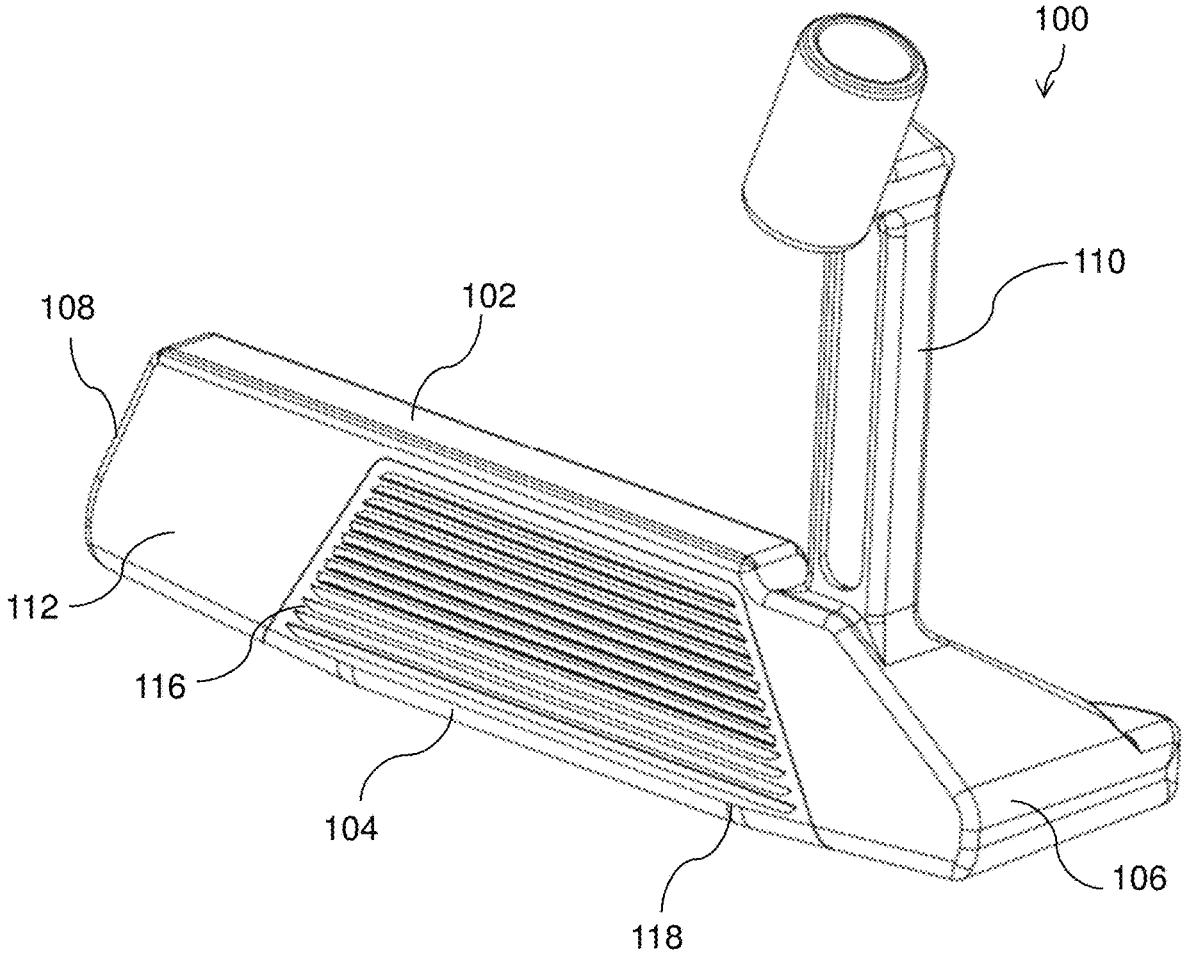
FIG. 1 is a front isometric view of a putter head in accordance with some embodiments of the present disclosure.

Referring to FIG. 1, a front isometric view of an illustrative embodiment of a putter head formed in accordance with some embodiments of the present disclosure is provided. Putter head 100, illustrated in FIG. 1, includes a top surface 102, a bottom surface or sole 104, a heel 106, a toe 108, and a hosel 110. The top surface 102 is directed generally towards the sky and the bottom surface 104 is directed generally toward the ground when the golfer addresses the golf ball. The heel 106 is generally directed towards the golfer and the toe 108 is generally directed away from the golfer when the golfer addresses the golf ball. The hosel 110 generally extends upwardly from the top surface 102, typically proximate to the heel 106, and is the portion of the putter head 100 to which a shaft is attached. The respective top surface 102, bottom surface 104, heel 106, toe 108, and hosel 110 may be formed in various shapes and sizes.

Figure 2:
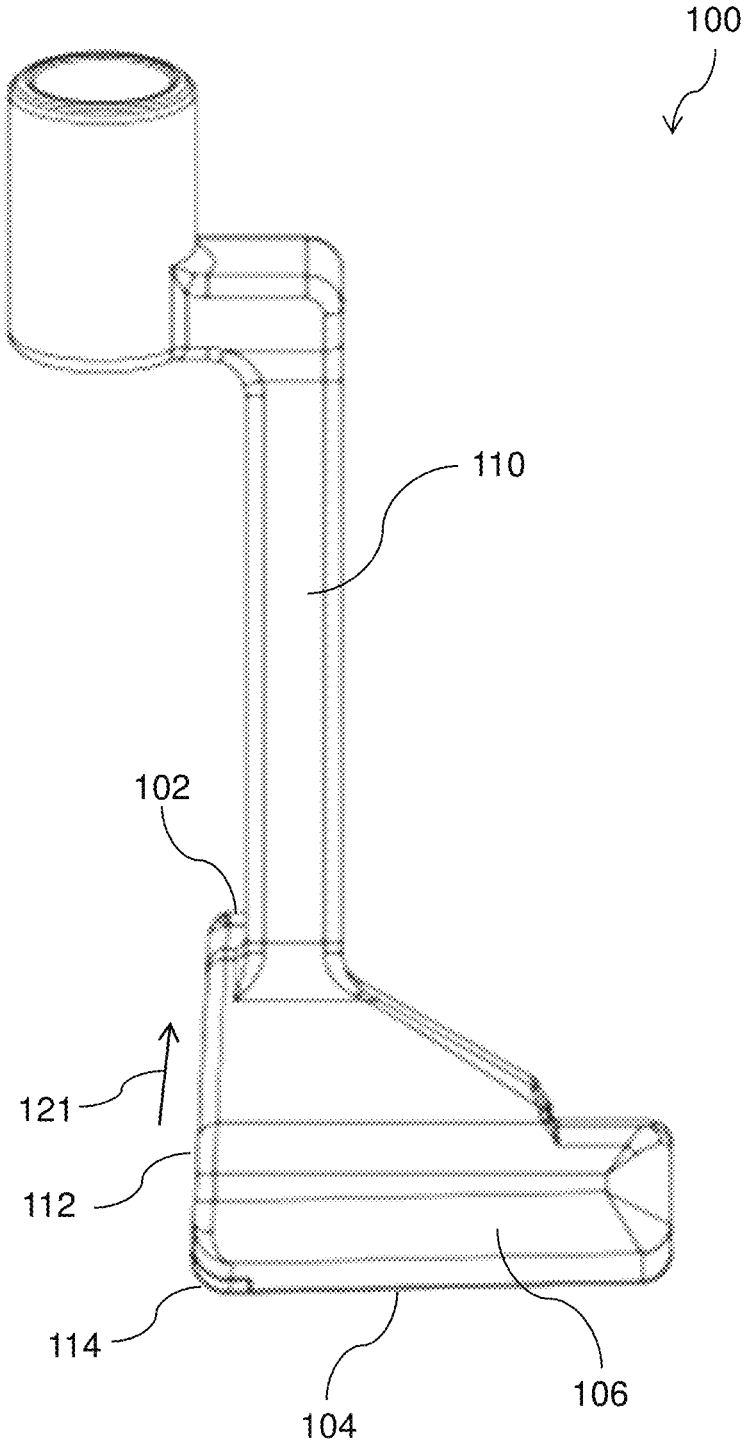
FIG. 2 is a side elevation view of the putter head of FIG. 1 in accordance with some embodiments of the present disclosure.

With continued reference to FIG. 1, the putter head 100 includes a face 112 that is directed generally towards a golf ball when the golfer addresses the golf ball. The putter face 112 generally extends between the top surface 102, the bottom surface 104, the heel 106, and the toe 108. As shown in FIG. 2, the putter face 112 may be substantially flat and planar. As further shown in FIG. 2, the putter face 112 may be lofted in order to lift the ball up onto the top of the green surface from a slight depression in which it rests. As the loft angle of the putter face 112 (generally referred to as static loft) increases, more lift will be imparted to the ball. The putter face 112 may have some degree of static loft. For example, the loft angle of the putter face 112 may range from about 1 degree to about 5 degrees. In some embodiments, the putter face 112 has a loft angle of about 3 degrees. With continued reference to FIG. 2, a lower, front edge 114 of the putter head 100 may be rounded to allow the putter face 112 to glide better through taller grass when used in the fringe of the green surface and to reduce the likelihood that the putter face 112 catches or grabs on the green surface during the course of play.

Figure 3:
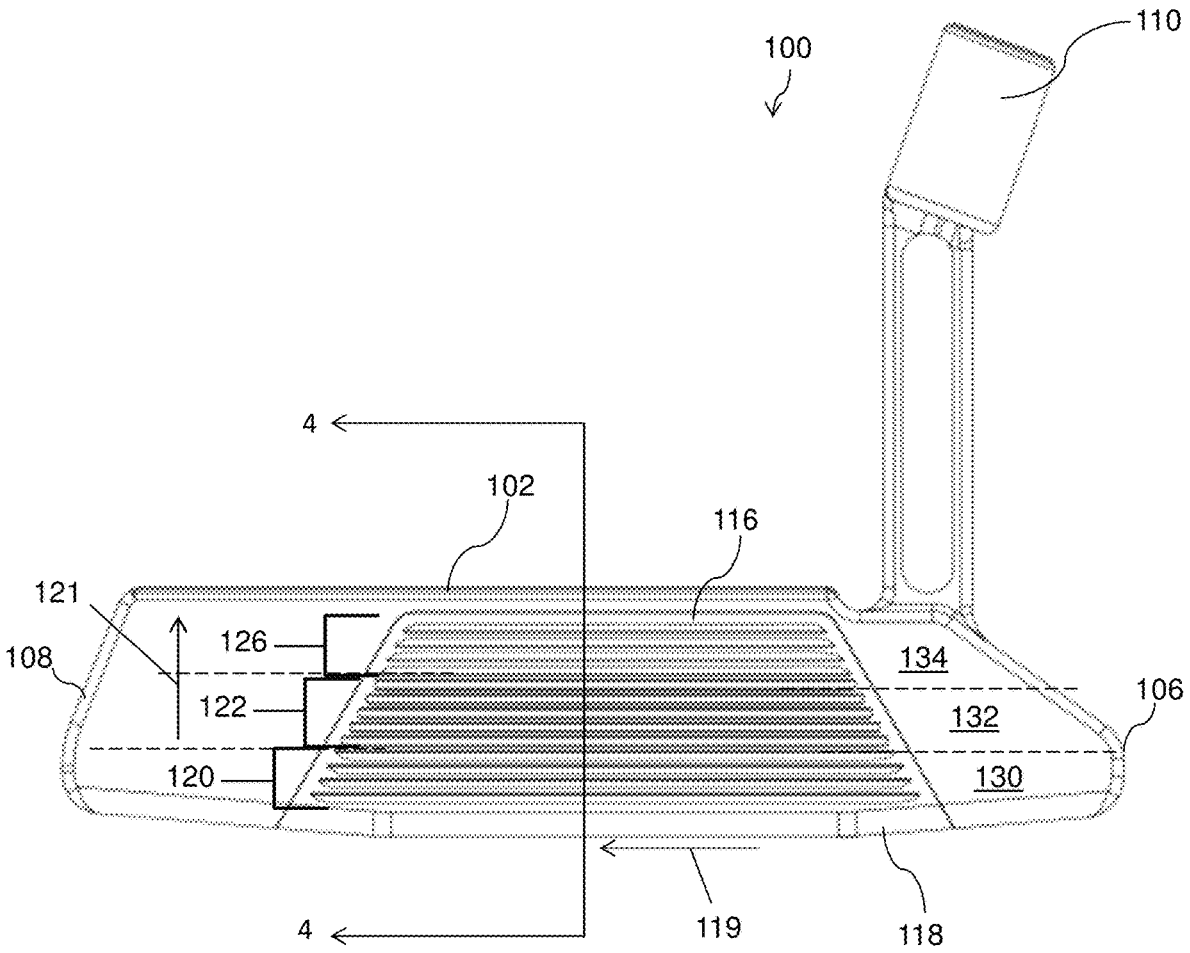
FIG. 3 is a front elevation view of the putter head of FIG. 1 in accordance with some embodiments of the present disclosure.

Referring back to FIG. 1, the putter face 112 includes a groove pattern 116. The groove pattern 116 may be cut, etched, molded, or otherwise formed in the putter face 112. The groove pattern 116 may be formed directly into a face of the putter head 100 (e.g., milled into the putter head), or, as shown in FIGS. 1 and 3-11, the groove pattern 116 may be formed in a putter face insert 118 that is attached to the putter head 100. As shown in FIG. 8, the putter head 100 may define a cavity 119 opening through the bottom surface 104 of the putter head 100 that receives the insert 118. By inserting the insert 118 through the opening in the bottom surface 104, the insert 118 may provide a softer feel when a ball is struck low on the putter face 112 in embodiments where the insert 118 is made from a softer material than the body of the putter head 100. The insert 118 also does not visually disturb the top surface 102 of the putter head 100, which may distract the golfer during putting. Although not shown, the cavity 119 may open through the top surface 102 of the putter head 100, or may not open through either the top surface 102 or the bottom surface 104. The insert 118 may be formed in a trapezoidal shape as shown in FIGS. 1, 3, and 8, a conic shape, a rectangular shape, or any other shape.

With continued reference to FIG. 1, the groove pattern 116 generally extends in a heel-to-toe direction 119 along the face 112 of the putter head 100. The groove pattern 116 generally increases the time the ball spends in contact with the putter face 112, generally referred to as dwell time, by reducing the surface area of the putter face 112 in contact with the ball, thereby providing the putter head 100 with a soft feel upon contact with the ball. The groove pattern 116 may be formed in a trapezoidal shaped perimeter as shown in FIG. 1, a conic shaped perimeter, a rectangular shaped perimeter, or any other shaped perimeter. The groove pattern 116 may extend partially across the putter face 112, for example as shown in FIG. 1, or may extend across the entire putter face 112 from the heel 106 to the toe 108.

Figure 4:
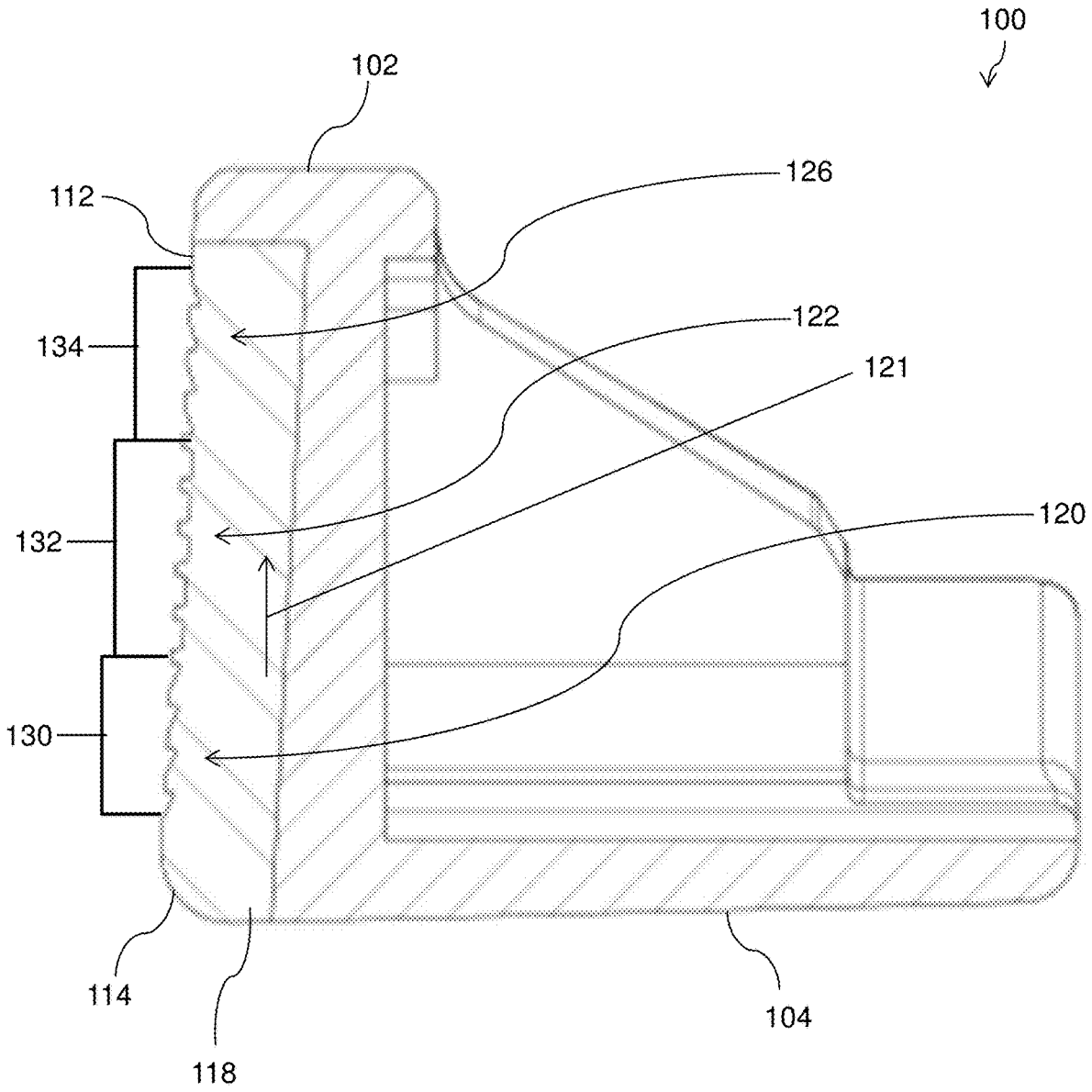
FIG. 4 is a cross-sectional view of the putter head of FIG. 1 taken along sectional line 4-4 of FIG. 3 in accordance with some embodiments of the present disclosure.

Referring to FIGS. 3 and 4, the groove pattern 116 includes multiple sets, regions, or zones of different grooves extending in a heel-to-toe direction 119 of the putter head 100 and spaced apart from one another in a vertical direction 121 of the putter face 112. The groove pattern 116 is configured to provide a golfer a relatively large margin of error in the angle of impact between the putter head 100 and the golf ball so that the ball travels straighter with a desired distance regardless of the golfer's variation in their swing from one putt to another putt. The groove pattern 116 generally improves the forward roll or rotation of the golf ball when the ball is struck off-center up and down the putter face 112. In FIGS. 3 and 4, the putter face 112 defines three sets of grooves. However, it should be appreciated the putter face 112 may include two, three, or more sets of grooves.

With continued reference to FIGS. 3 and 4, the putter face 112 includes a first set, region, or zone of grooves 120 (hereinafter "first set of grooves" for the sake of convenience without intent to limit) and a second set, region, or zone of grooves 122 (hereinafter "second set of grooves" for the sake of convenience without intent to limit). The first and second set of grooves 120, 122 extend in the heel-to-toe direction 119 of the putter head 100 and are spaced apart from each other in the vertical direction 121 of the putter face 112. The vertical direction 121 of the putter face 112 is oriented generally perpendicular to the heel-to-toe direction 119 of the putter head 100 and generally parallel to the putter face 112. As shown in FIGS. 3 and 4, the putter face 112 may include a third set, region, or zone of grooves 126 (hereinafter "third set of grooves" for the sake of convenience without intent to limit) extending in the heel-to-toe direction 119 of the putter head 100. The third set of grooves 126 may be spaced apart from the first and second set of grooves 120, 122 in the vertical direction 121.

Referring still to FIGS. 3 and 4, the second set of grooves 122 may be located vertically between the first set of grooves 120 and the third set of grooves 126. The first set of grooves 120, the second set of grooves 122, and the third set of grooves 126 may extend parallel to one another along the putter face 112. The first set of grooves 120 may be located in a lower region 130 of the putter face 112 generally below a center of gravity of the putter head 100. The third set of grooves 126 may be located in an upper region 134 of the putter face 112 generally above a center of gravity of the putter head 100. The second set of grooves 122 may be located in a middle region 132 of the putter face 112 generally in front of a center of gravity of the putter head 100. The lower region 130 may be located near the bottom surface 104 of the putter head 100 in a lower one-third portion of the putter face 112, the upper region 134 be located near the top surface 102 of the putter head 100 in an upper one-third portion of the putter face 112, and the middle region 132 may be located between the lower and upper regions 130, 134 in a middle one-third portion of the putter face 112.

Figure 5:
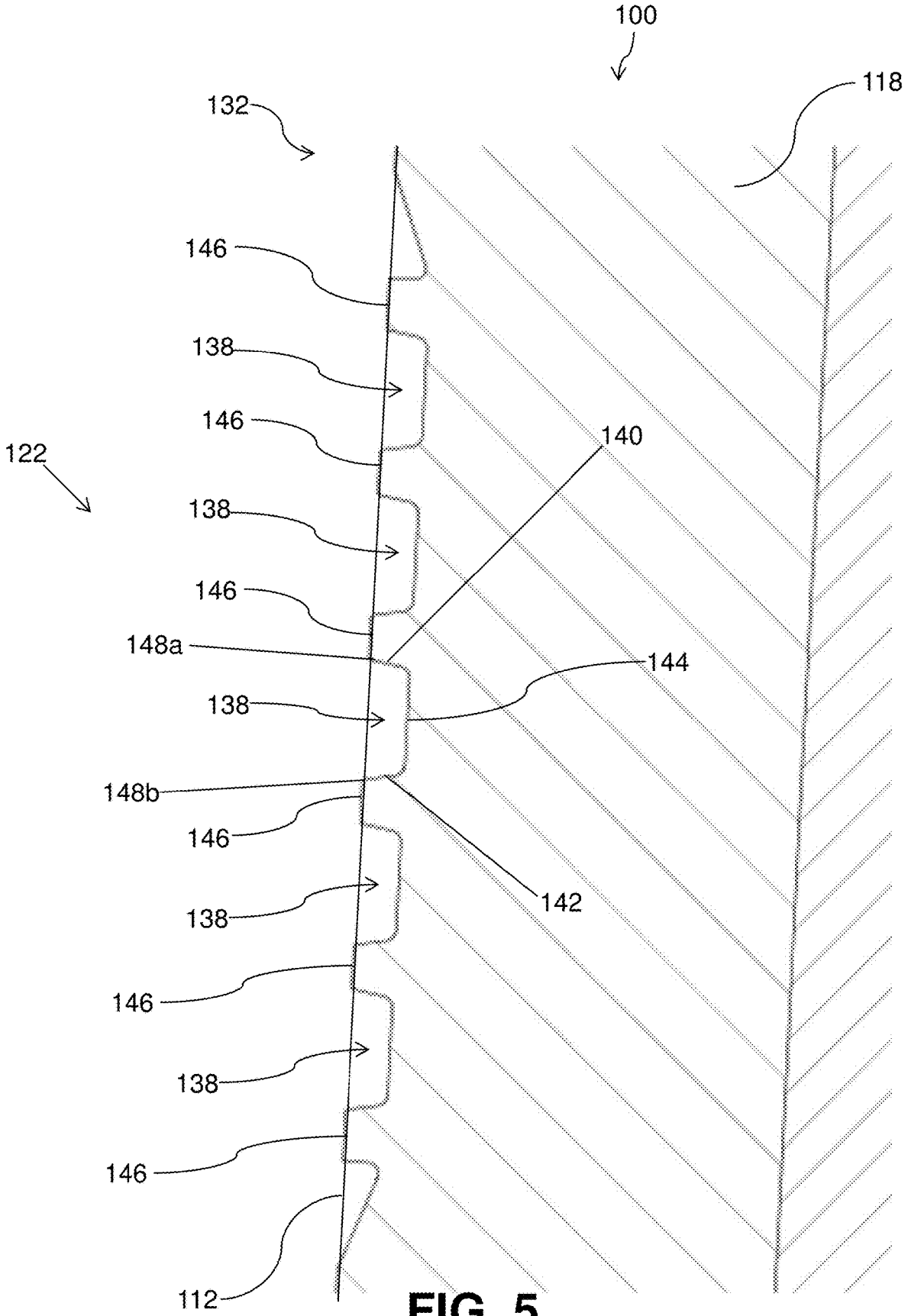
FIG. 5 is an enlarged, fragmentary view of a middle region of the putter face shown in the cross-sectional view of FIG. 4 in accordance with some embodiments of the present disclosure.

Referring to FIG. 5, an enlarged cross-sectional view of the middle region 132 of the putter face 112 is provided. The middle region 132, as shown in FIG. 5, may include the second set of grooves 122. The second set of grooves 122 generally contacts the golf ball when the putter head 100 strikes the ball near the vertical center of the putter face 112 and/or center of gravity of the putter head 100. In FIG. 5, the second set of grooves 122 includes five grooves formed in the putter face 112. It should be understood that the second set of grooves 122 may include more or less than five grooves. For example, in some configurations, the second set of grooves 122 includes a single groove. In some configurations, the second set of grooves 122 includes two or more grooves.

Referring still to FIG. 5, each groove 138 of the second set of grooves 122 may have a symmetrical cross-sectional configuration or shape. In FIG. 5, each groove 138 of the illustrative embodiment has a substantially square cross-sectional configuration including an upper or first wall surface 140 and a lower or second wall surface 142 that each extend inwardly into the putter head 100 and are connected together by a substantially flat surface 144 located at a bottom of the groove 138. The upper and lower walls surfaces 140, 142 may extend substantially perpendicularly (e.g., at a ninety degree angle) to the putter face 112 and the substantially flat surfaces 144. In some embodiments, the upper and lower wall surfaces 140, 142 may extend toward one another as they extend inwardly into the putter head 100. In some embodiments, the upper and lower wall surfaces 140, 142 have about a 10 degree draft angle, and the depth of each respective groove 138 is about 0.015 inches. Although the grooves 138 shown in FIG. 5 have a substantially square cross-sectional configuration, in some embodiments the grooves 138 have other symmetrical cross-sectional configurations, such as a V-shaped cross-sectional configuration having upper and lower wall surfaces 140, 142 intersect at a bottom of the respective grooves 138 or a parallelogram configuration.

With continued reference to FIG. 5, adjacent grooves 138 of the second set of grooves 122 may be separated from each other by intermediate surfaces 146 of the putter face 112. The intermediate surfaces 146 may be flat and coplanar with the putter face 112. The intersection of the upper wall surface 140 and a respective superjacent intermediate surface 146 may form an upper or first groove edge **148*a*, and the intersection of the lower wall surface 142 and a respective subjacent intermediate surface 146 may form a lower or second groove edge 148*b* for each groove 138. The upper and lower groove edges 148*a*, 148*b* generally have the same angle or sharpness. The upper and lower groove edges 148*a*, 148*b* may be formed by substantially right angles (e.g., about seventy-five to one-hundred and five degree angles) defined by the intersections of the upper and lower wall surfaces 140, 142, and the intermediate surfaces 146. The upper and lower edges 148*a*, 148*b* may be coplanar with the putter face 112. The distance between the upper and lower edges 148*a*, 148*b* generally defines the opening or mouth of each groove 138, which may be greater in dimension than the respective intermediate surfaces 146 in the vertical direction 119 of the putter face 112**.

Figure 9:
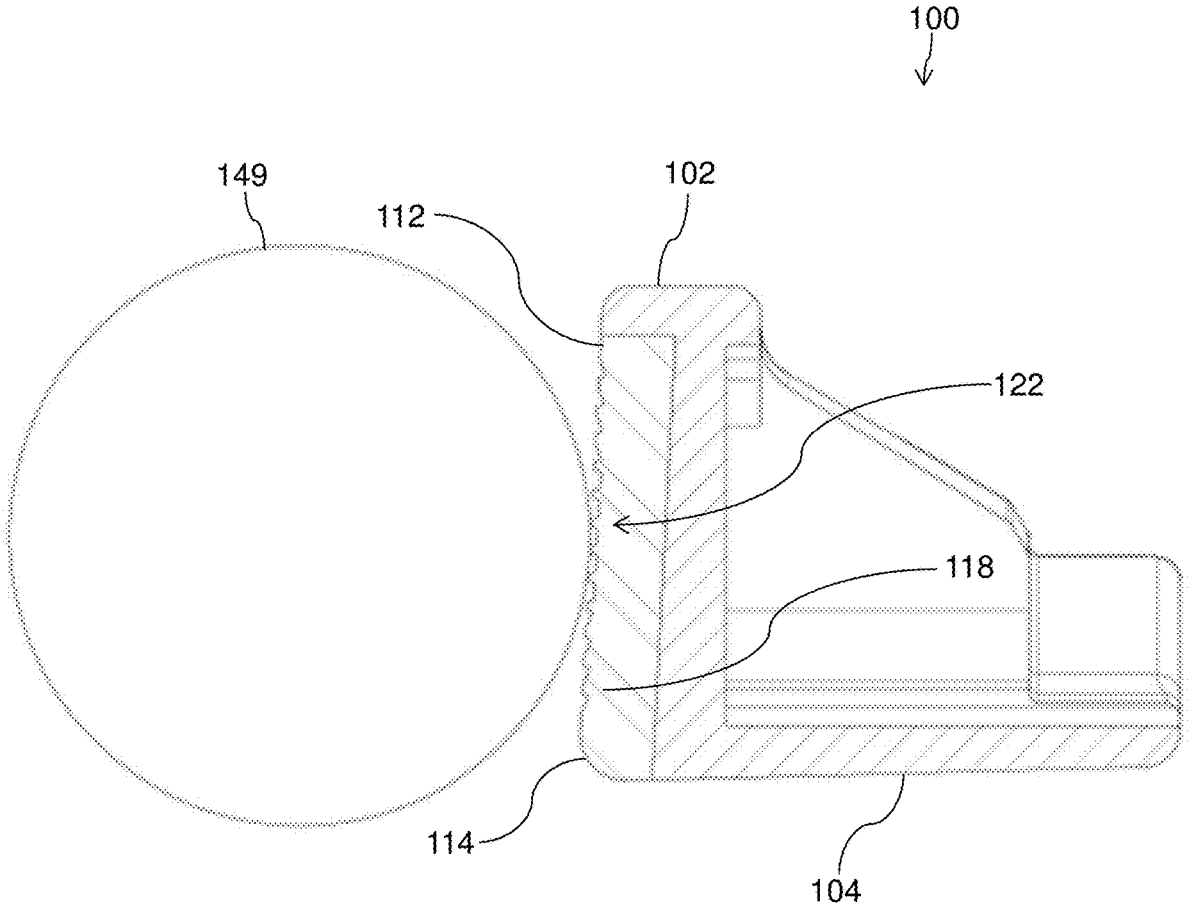
FIG. 9 is a cross-sectional view of the putter head of FIG. 1 taken along sectional line 4-4 of FIG. 3 with a middle region of the putter face in contact with a golf ball in accordance with some embodiments of the present disclosure.

Referring to FIG. 9, when a golf ball 149 is struck near the vertical center of the putter face 112 and/or center of gravity of the putter head 100, the intermediate surfaces 146 generally strike the back of the ball 149 with little or no need for modulation of the launch angle by the groove edges **148*a*, 148*b* since the static loft angle of the putter face 112 imparts a desired launch angle to the ball 149, causing the ball 149 to roll forward in a desired path, with the static loft angle of the putter face 112 slightly lifting the ball 149 out of a depression in which it rests. To the extent the ball is struck in the middle region 132 of the putter head 100 but the putter face 112 is angled forwardly or rearwardly of the desired static loft angle, one or more of the upper and lower groove edges 148*a*, 148*b* engage the outer surface of the ball 149, thereby altering the launch angle of the ball 149 to counteract the misalignment of the putter face 112 relative to the ball 149, resulting in improved putting performance. The launch angle is the angle at which the golf ball is launched into the air after contacting the putter face 112**, and generally is measured between a projected path of the golf ball and a horizontal or ground plane. Both dynamic loft angle and static loft angle affect the launch angle. Dynamic loft angle generally is a combination of the static loft angle, the lean of the shaft, and the path of the club head as the golfer swings and addresses the ball. Static loft angle generally is defined by the plane in which the putter face lies. Many other factors may also affect the degree of launch angle.

Figure 6:
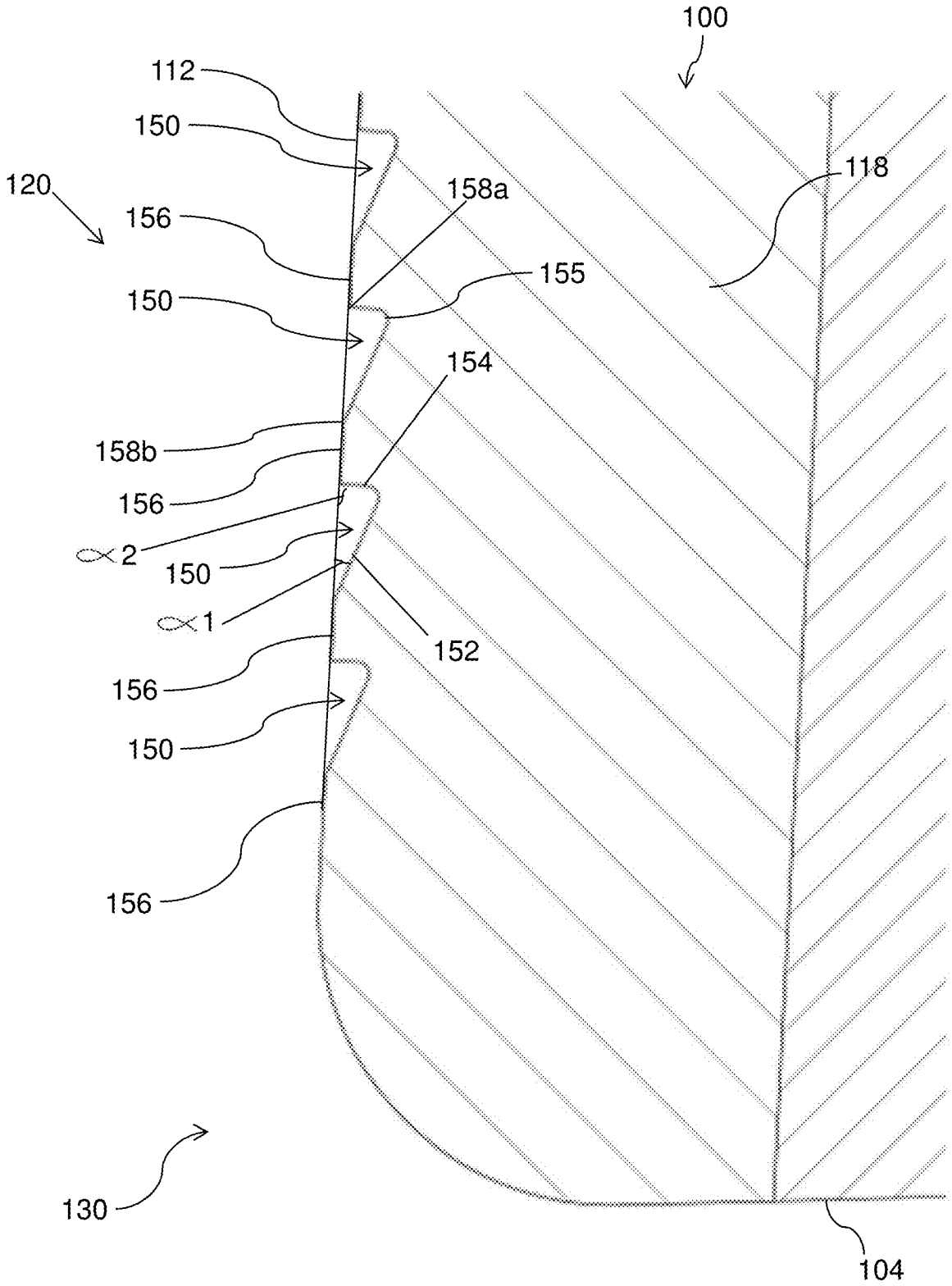
FIG. 6 is an enlarged, fragmentary view of a lower region of a putter face shown in the cross-sectional view of FIG. 4 in accordance with some embodiments of the present disclosure.

Referring to FIG. 6, an enlarged cross-sectional view of the lower region 130 of the putter face 112 is provided. The lower region 130, as shown in FIG. 6, may include the first set of grooves 120. The first set of grooves 122 generally contacts the golf ball when the putter head 100 strikes the ball below the vertical center of the putter face 112 and/or center of gravity of the putter head 100. In FIG. 6, the first set of grooves 120 includes four grooves formed in the putter face 112. It should be understood that the first set of grooves 120 may include more or less than four grooves. For example, in some configurations, the first set of grooves 120 includes a single groove. In some configurations, the first set of grooves 120 includes two or more grooves.

Referring to FIGS. 5 and 6, the first and second set of grooves 120, 122 have different cross-sectional configurations. Referring specifically to FIG. 6, each groove 150 of the first set of grooves 120 has a non-symmetrical cross-sectional configuration or shape. In FIG. 6, each groove 150 of the illustrative embodiment extends upwardly into the putter head 100. Each groove 150 may be defined by a lower or first wall surface 152 and an upper or second wall surface 154. The lower wall surface 152 may extend upwardly and inwardly into the putter head 100 at a first angle $\alpha 1$ relative to the putter face 112, and the upper wall surface 154 may extend inwardly into the putter head 100 at a second angle $\alpha 2$ relative to the putter face 112 that is greater than the first angle $\alpha 1$. The upper wall surface 154 may extend downwardly into the putter head 100 at the second angle $\alpha 2$. In some embodiments, the first angle $\alpha 1$ is about 20 degrees, and the second angle $\alpha 2$ is about 80 degrees, although other angles are contemplated. The lower and upper wall surfaces 152, 154 may extend toward one another as they extend inwardly into the putter head 100 and may intersect at a bottom 155 of a respective groove 150.

With continued reference to FIG. 6, adjacent grooves 150 of the first set of grooves 120 may be separated from each other by intermediate surfaces 156. The intermediate surfaces 156 may be flat and coplanar with the putter face 112. The intersection of the upper wall surface 154 and a respective superjacent intermediate surface 156 may form an upper or first groove edge 158*a*, and the intersection of the lower wall surface 152 and a respective subjacent intermediate surface 156 may form a lower or second groove edge 158*b* for each groove 150. The upper groove edges 158*a* are sharper (e.g., have sharper angles) than the lower grooves edges 158*b* based on the different angles $\alpha 2$, $\alpha 1$ of the upper and lower wall surfaces 154, 152, respectively. The upper groove edges 158*a* may be formed by substantially right angles (e.g., about seventy-five to one-hundred and five degree angles) defined by the intersections of the upper wall surfaces 154 and the intermediate surfaces 156, whereas the lower groove edges 158*b* may be formed by substantially obtuse angles (i.e., greater than ninety degree angles) defined by the intersections of the lower wall surfaces 152 and the intermediate surfaces 156. The upper and lower edges 158*a*, 158*b* may be coplanar with the putter face 112. The distance between the upper and lower edges 158*a*, 158*b* generally defines the opening or mouth of each groove 150, which may be greater in dimension than the respective intermediate surfaces 156 in the vertical direction 119 of the putter face 112.

Figure 10:
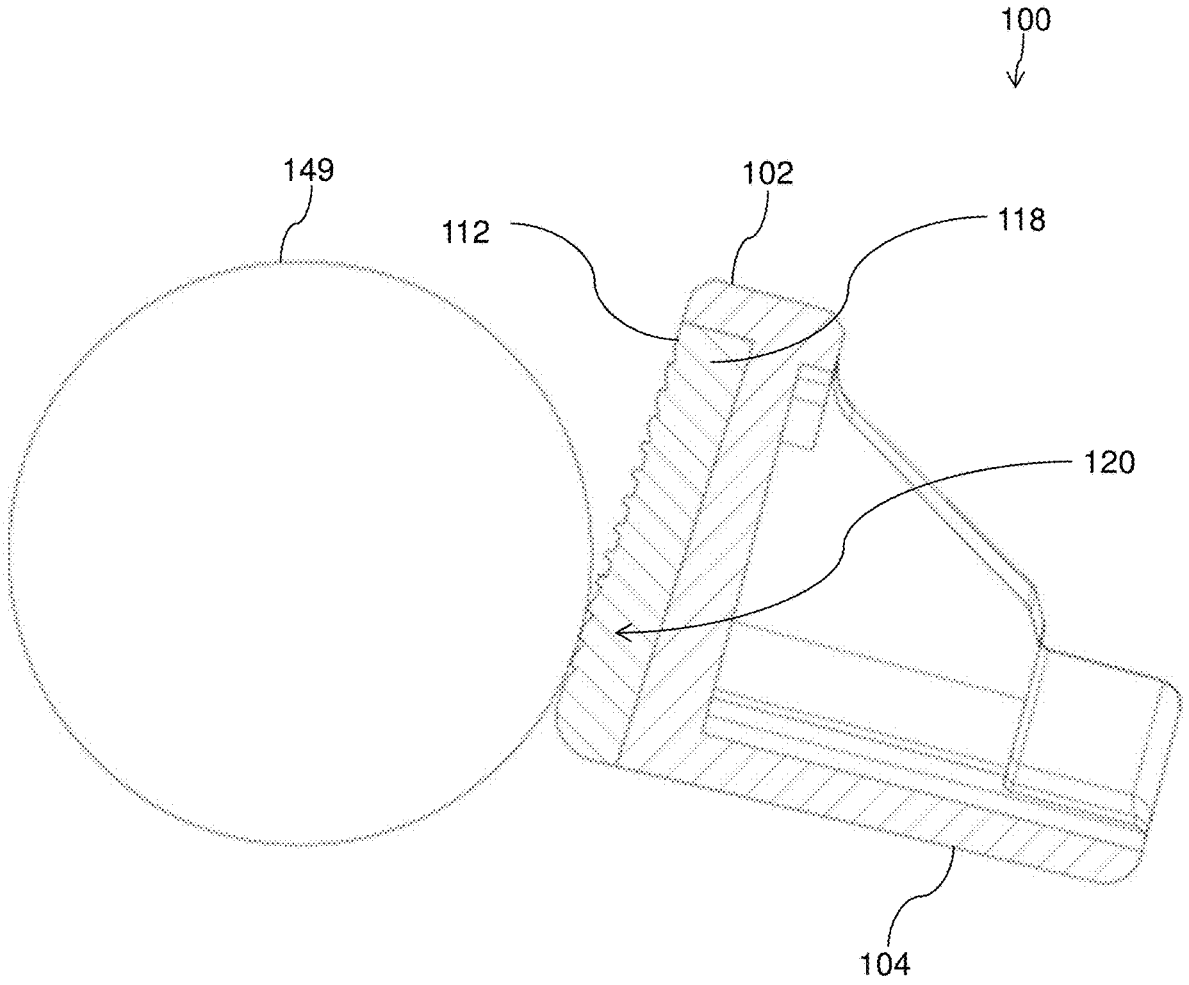
FIG. 10 is a cross-sectional view of the putter head of FIG. 1 taken along sectional line 4-4 of FIG. 3 with a lower region of the putter face in contact with a golf ball in accordance with some embodiments of the present disclosure.

Generally, when a golf ball is struck below a vertical center of a putter face and/or center of gravity of a putter head, the shaft and the putter face typically are tilted rearwardly, causing more loft to be presented at the point of impact. This increased loft typically causes the ball to launch higher than desired, resulting in decreased distance and accuracy. Referring to FIGS. 6 and 10, the first set of grooves 120 modulates this undesired loft angle to improve putter performance. When the putter face 112 is tilted backwards and the lower region 120 of the putter face 112 impacts the golf ball 149, one or more of the upper and lower groove edges 158*a*, 158*b* engage the outer surface of the ball 149. The sharper angle of the upper groove edges 158*a* relative to the lower groove edges 158*b* reduces the launch angle of the ball 149, thereby lifting the ball on top of the green surface without launching the ball into the air, resulting in reduced bouncing and backspin and improved putting performance.

Figure 7:
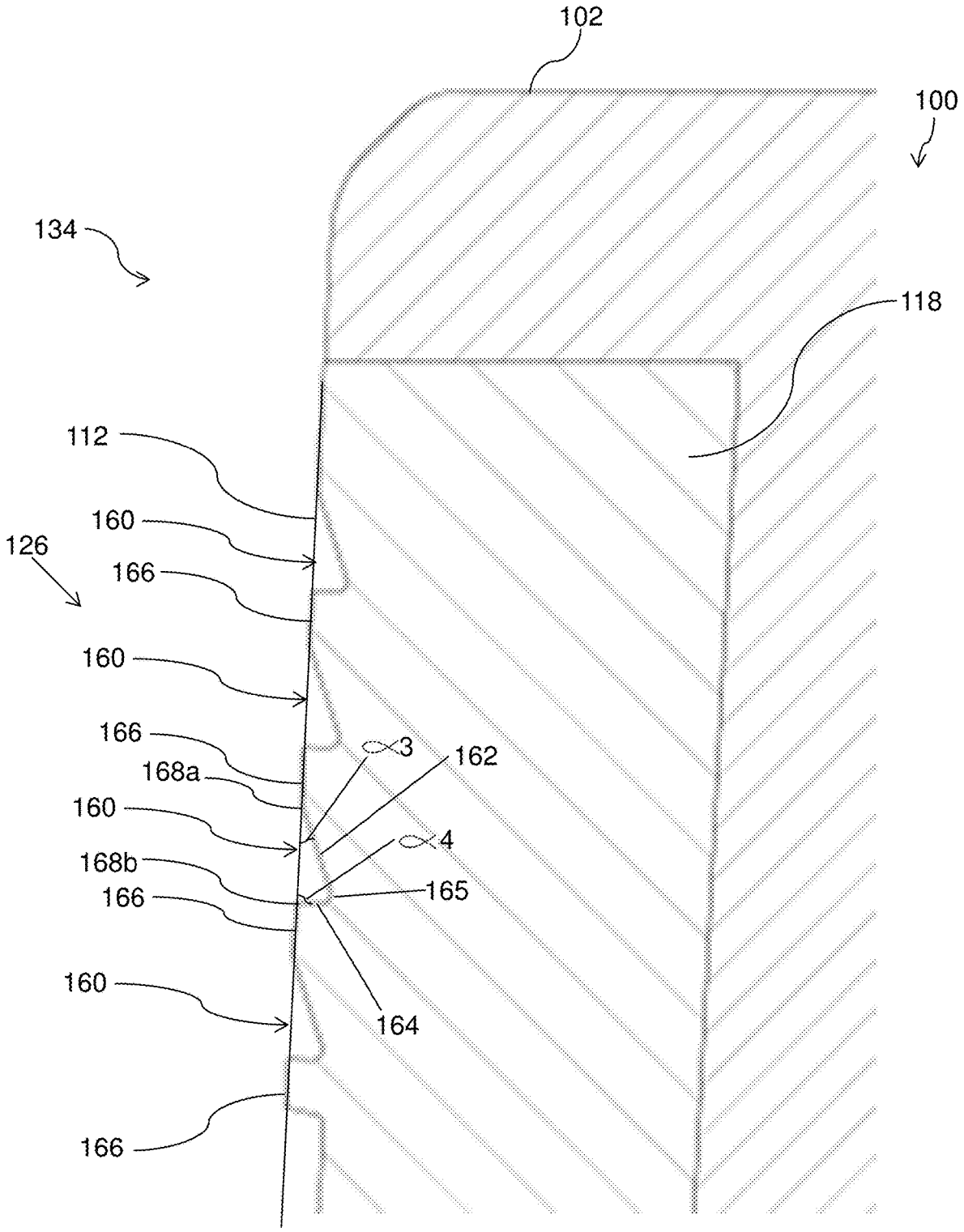
FIG. 7 is an enlarged, fragmentary view of an upper region of the putter face shown in the cross-sectional view of FIG. 4 in accordance with some embodiments of the present disclosure.
Figure 8:
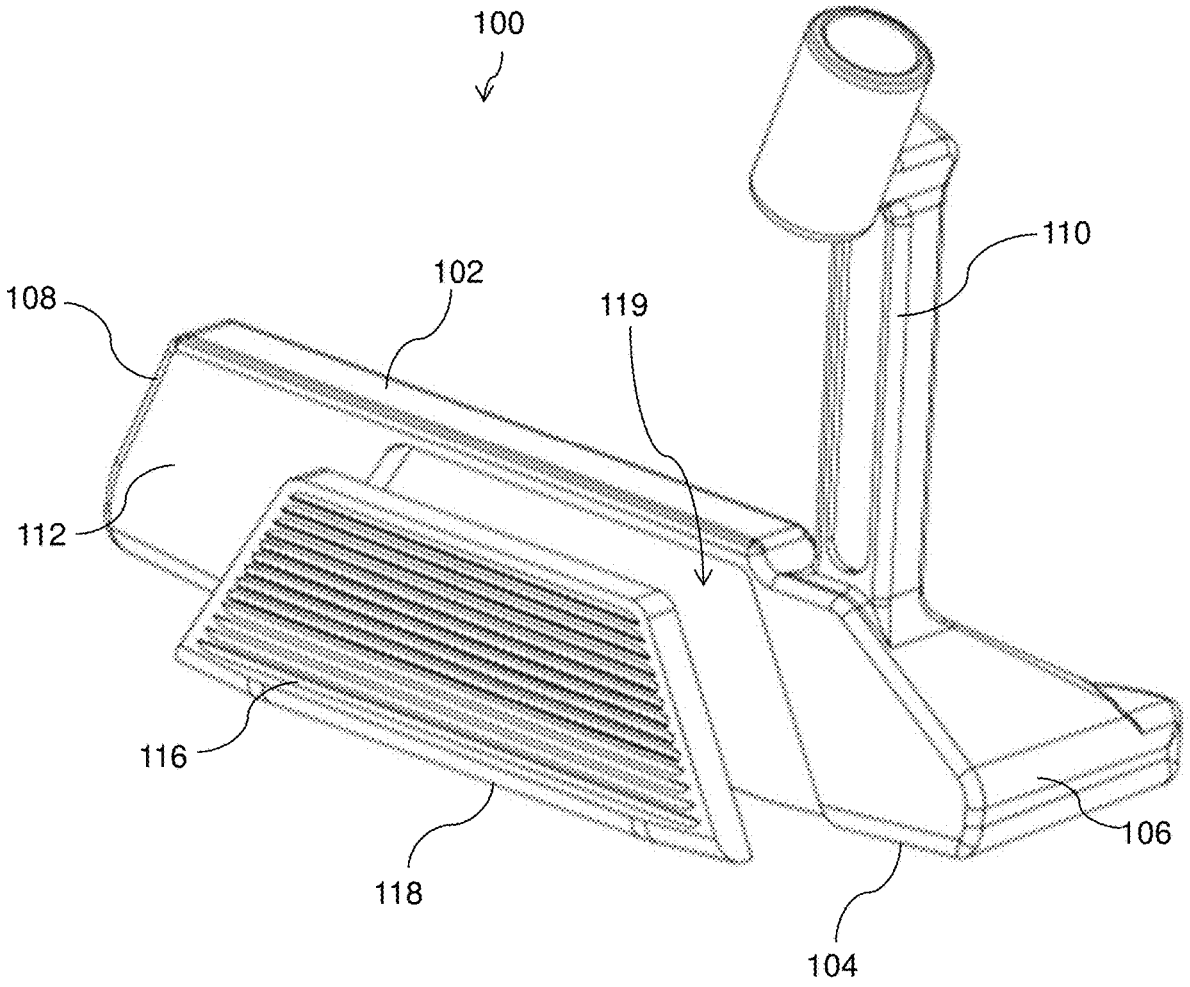
FIG. 8 is a front isometric, exploded view of a putter head in accordance with some embodiments of the present disclosure.

Referring to FIG. 7, an enlarged cross-sectional view of the upper region 134 of the putter face 112 is provided. The upper region 134, as shown in FIG. 7, may include the third set of grooves 126. The third set of grooves 126 generally contacts the golf ball when the putter head 100 strikes the ball above the vertical center of the putter face 112 and/or center of gravity of the putter head 100. In FIG. 7, the third set of grooves 126 includes four grooves formed in the putter face 112. It should be understood that the third set of grooves 126 may include more or less than four grooves. For example, in some configurations, the third set of grooves 126 includes a single groove. In some configurations, the third set of grooves 126 includes two or more grooves.

Referring to FIGS. 5 and 7, the second and third set of grooves 122, 126 have different cross-sectional configurations. Referring to FIGS. 4-7, the first and third set of grooves 120, 126 may be symmetrical about a plane that is oriented parallel to the sole 104 of the putter head 100, extends in the heel-to-toe direction 119, and bisects the second set of grooves 122. Referring specifically to FIG. 7, each groove 160 of the third set of grooves 126 has a non-symmetrical cross-sectional configuration or shape. In FIG. 7, each groove 160 of the illustrative embodiment extends downwardly into the putter head 100. Each groove 160 may be defined by an upper or first wall surface 162 and a lower or second wall surface 164. The upper wall surface 162 may extend downwardly and inwardly into the putter head 100 at a first angle $\alpha 3$ relative to the putter face 112, and the lower wall surface 164 may extend inwardly into the putter head 100 at a second angle $\alpha 4$ relative to the putter face 112 that is greater than the first angle $\alpha 3$. The lower wall surface 164 may extend upwardly into the putter head 100 at the second angle $\alpha 4$. In some embodiments, the first angle $\alpha 3$ is about 20 degrees, and the second angle $\alpha 4$ is about 80 degrees, although other angles are contemplated. The upper and lower wall surfaces 162, 164 may extend toward one another as they extend inwardly into the putter head 100 and may intersect at a bottom 165 of the respective groove 160.

With continued reference to FIG. 7, adjacent grooves 160 of the third set of grooves 126 may be separated from each other by intermediate surfaces 166. The intermediate surfaces 166 may be flat and coplanar with the putter face 112. The intersection of the upper wall surface 162 and a respective superjacent intermediate surface 166 may form an upper or first groove edge 168*a*, and the intersection of the lower wall surface 164 and a respective subjacent intermediate surface 166 may form a lower or second groove edge 168*b* for each groove 160. The lower groove edges 168*b* are sharper (e.g., have sharper angles) than the upper grooves edges 168*a* based on the different angles $\alpha 4$, $\alpha 3$ of the lower and upper wall surfaces 164, 162, respectively. The upper groove edges 168*a* may be formed by substantially obtuse angles (i.e., greater than ninety degree angles) defined by the intersections of the upper wall surfaces 162 and the intermediate surfaces 166, whereas the lower groove edges 168*b* may be formed by substantially right angles (e.g., about seventy-five to one-hundred and five degree angles) defined by the intersections of the lower wall surfaces 164 and the intermediate surfaces 166. The upper and lower edges 168*a*, 168*b* may be coplanar with the putter face 112. The distance between the upper and lower edges 168*a*, 168*b* generally defines the opening or mouth of each groove 160, which may be greater in dimension than the respective intermediate surfaces 166 in the vertical direction 119 of the putter face 112.

Figure 11:
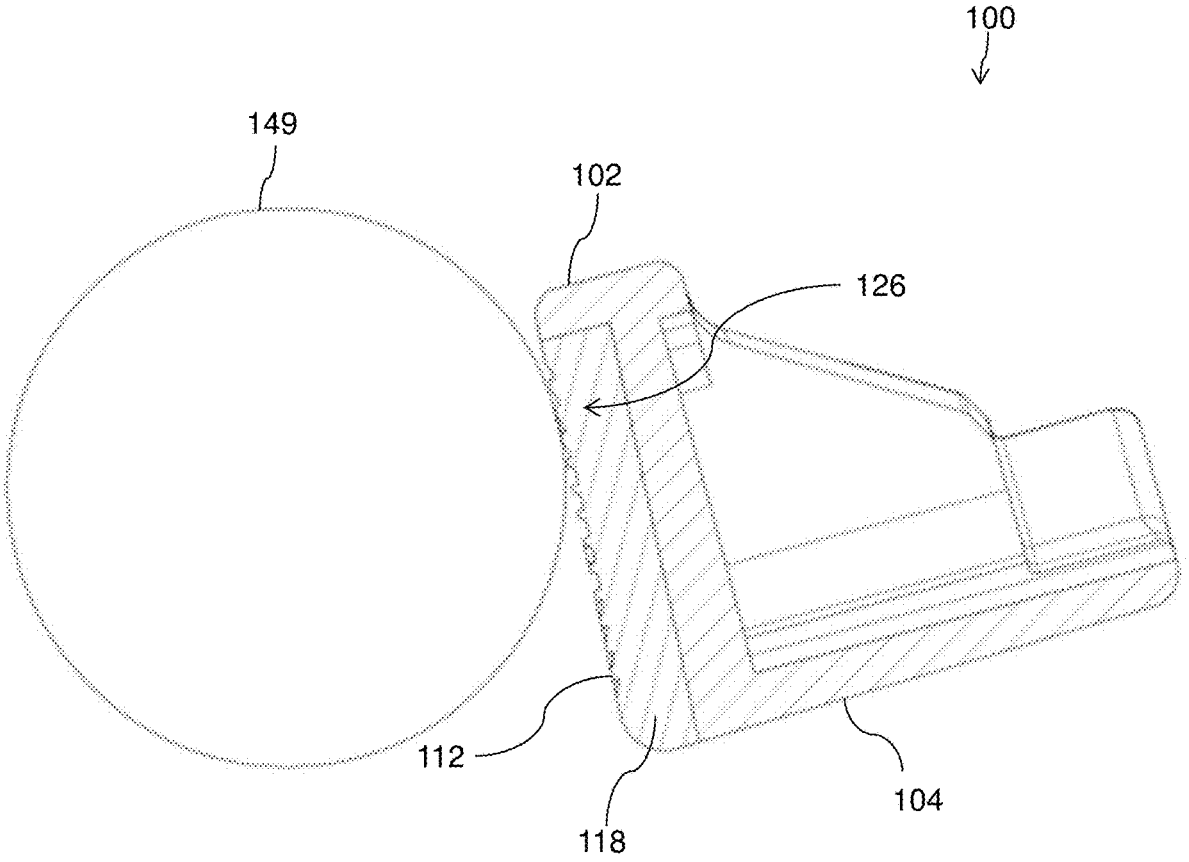
FIG. 11 is a cross-sectional view of the putter head of FIG. 1 taken along sectional line 4-4 of FIG. 3 with an upper region of the putter face in contact with a golf ball in accordance with some embodiments of the present disclosure.

Generally, when a golf ball is struck above a vertical center of a putter face and/or center of gravity of the putter head, the shaft and the putter face typically are tilted forwardly, causing decreased loft to be presented at the point of ball impact. This decreased loft typically causes the ball to launch into the ground, resulting in decreased distance and accuracy. Referring to FIGS. 7 and 11, the third set of grooves 126 modulates this undesired loft angle to improve putter performance. When the putter face 112 is tilted forwards and the upper region 126 of the putter face 112 impacts the golf ball 149, one or more of the upper and lower groove edges 156*a*, 168*b* engage the outer surface of the ball 149. The sharper angle of the lower groove edges 168*b* relative to the upper groove edges 168*a* increases the launch angle of the ball 149, thereby lifting the ball on top of the green surface, rather than driving the ball into the ground, resulting in improved putting performance.

With reference to FIGS. 1-12, the putter head 100 may be formed of various materials, including metallic materials, non-metallic materials, or a combination of both. In some embodiments, the putter head 100 is formed of a stainless steel material, such as 303 and/or 304 stainless steel, which is forged steel that provides a softer feel at impact because of the density of the material. Referring to FIGS. 1 and 3-11, if the putter head 100 includes a putter face insert 118, the insert 118 may be formed of a polymer, for example. Golfers generally prefer a softer feeling putter, and polymer inserts have a much softer durometer measurement than a steel face insert. The softer durometer measurement of the polymer insert also increases the dwell time of the ball, resulting in increased friction between the ball and the putter face 112, and thereby improving ball roll and launch conditions measured by how quickly and consistently the ball begins forward rotation. In some embodiments, the insert 118 may be formed of polyurethane, which is easy to manufacture and allows the manufacturer to select different hardness factors for the insert 118, which impacts the feel of the putter.

In some groove pattern configurations, the first and third set of grooves 120, 126 may gradually transition into the second set of grooves 122. For example, the non-symmetrical cross-sectional configurations of the first and third set of grooves 120, 126 may gradually transition into the symmetrical cross-sectional configuration of the second set of grooves 122, which may include one or more substantially square grooves. In other words, the cross-sectional configurations of the first and third set of grooves 120, 126 may gradually become more symmetrical as they approach the second set of grooves 122 so that the first and third set of grooves 120, 126 gradually transition into the second set of grooves 122. By gradually transitioning the first and third set of grooves 120, 126 into the second set of grooves 122, the groove pattern 116 provides a continuously varying launch angle modulation along the vertical direction 119 of the putter face 112.

Figure 12:
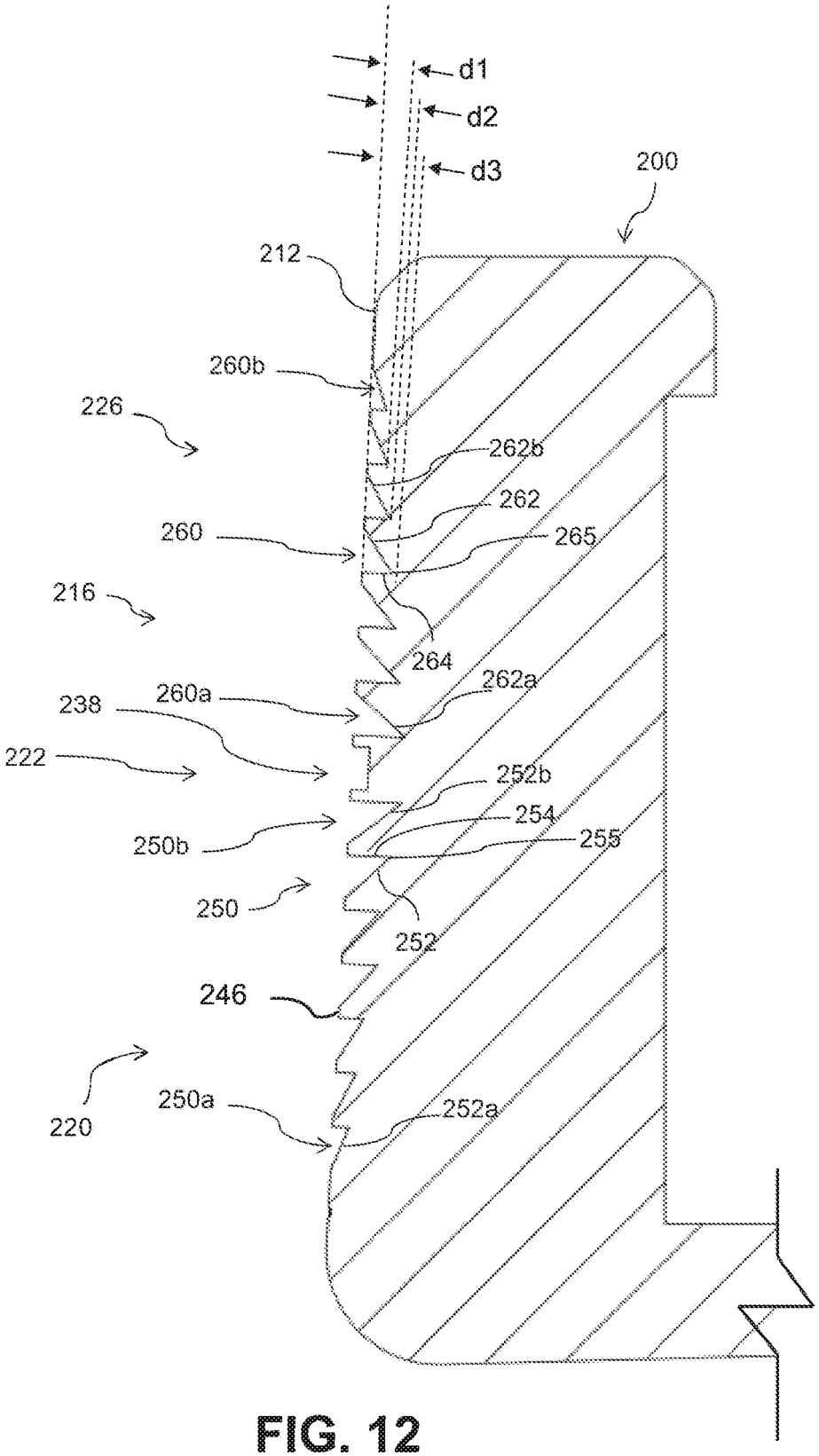
FIG. 12 is a view of a putter head including a different groove configuration relative to FIG. 4 in accordance with some embodiments of the present disclosure.
Figure 13:
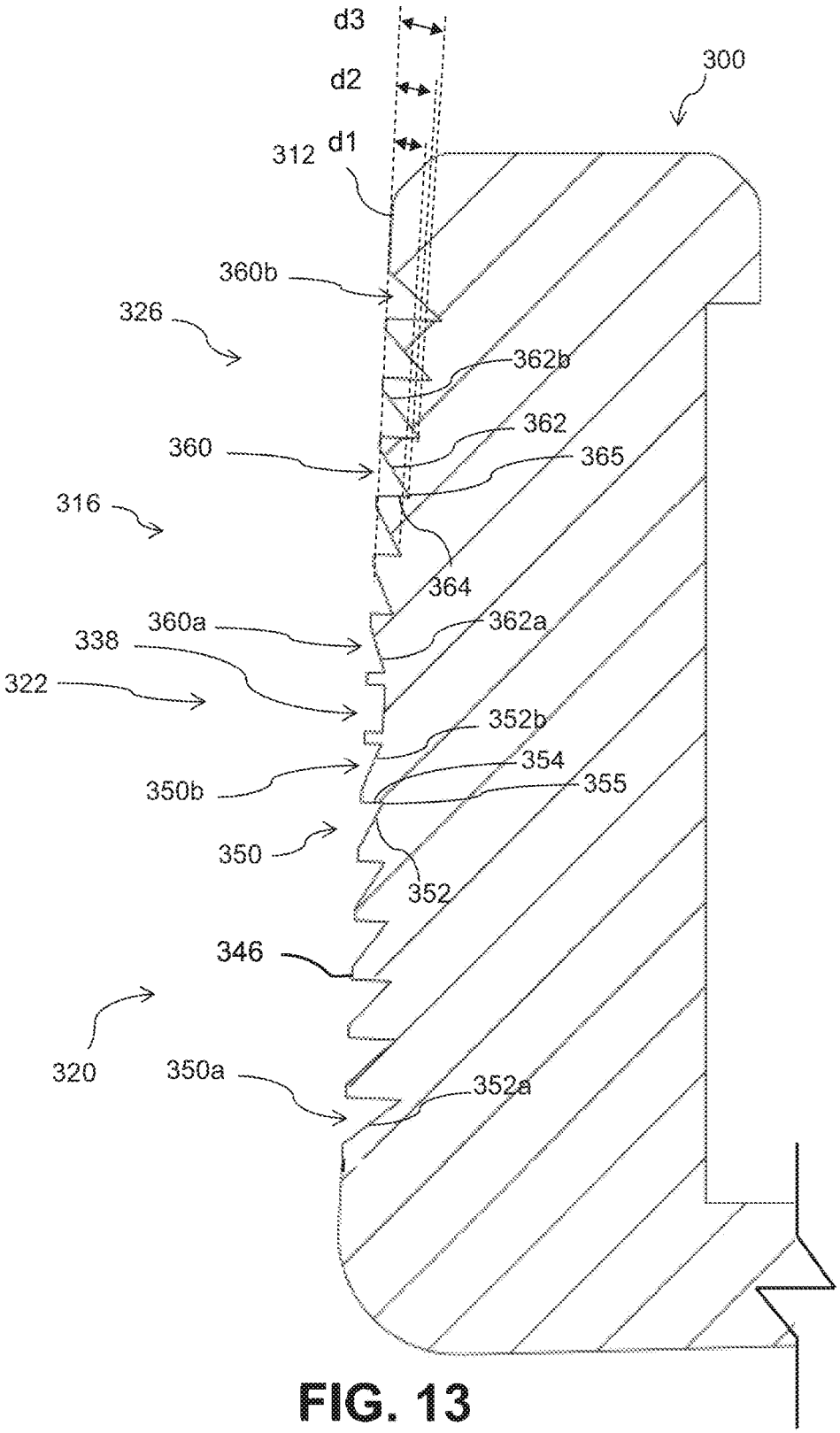
FIG. 13 is a view of a putter head including a different groove configuration relative to FIGS. 4 and 12 in accordance with some embodiments of the present disclosure.

With the exception of the groove patterns 216, 316 illustrated in FIGS. 12 and 13, respectively, the putter heads 200 and 300 illustrated in FIGS. 12 and 13, respectively, have the same features and operation as the putter head 100 depicted in FIGS. 1-11. Accordingly, the preceding discussion of the features and operation of the putter head 100 should be considered equally applicable to the putter heads 200 and 300 illustrated in FIGS. 12 and 13, except as noted in the following discussion pertaining to the groove patterns 216 and 316.

Referring to FIG. 12, the groove pattern 216 includes a first set, region, or zone of grooves 220 (hereinafter "first set of grooves" for the sake of convenience without intent to limit), a second set, region, or zone of grooves 222 (hereinafter "second set of grooves" for the sake of convenience without intent to limit), and a third set, region, or zone of grooves 226 (hereinafter "third set of grooves" for the sake of convenience without intent to limit). In FIG. 12, the first set of grooves 220 includes seven grooves formed in the putter face 212, the second set of grooves 222 includes a single groove formed in the putter face 212, and the third set of grooves 226 includes seven grooves formed in the putter face 212. It should be understood that the first set of grooves 220, the second set of grooves 222, and the third set of grooves 226 may include more or less than the grooves illustrated in FIG. 12. The first set of grooves 220 may extend at an incline from the putter face 212 into the putter head 200, and the third set of grooves 226 may extend at a decline from the putter face 212 into the putter head 200. The groove pattern 216 may exhibit a gradual change in the pitch of the groove angles in the first set of grooves 220 and the third set of grooves 226 along the vertical profile of the putter face 212. Each groove in the first set of grooves 220 and in the third set of grooves 226 may have a unique pitch. The pitch of adjacent grooves in the first set of grooves 220 and in the third set of grooves 226 along the vertical profile of the putter face 212 may differ by a delta amount, such as about 5 degrees. The delta amount may vary depending on the putter.

Referring still to FIG. 12, each groove 250 of the first set of grooves 220 may have a non-symmetrical cross-sectional configuration or shape. In FIG. 12, each groove 250 may extend upwardly into the putter head 200. Each groove 250 may be defined by a lower or first wall surface 252 and an upper or second wall surface 254, which may intersect each other to define a bottom or vertex 255 of the respective groove 250. The lower wall surface 252 may extend at an incline angle or pitch from the putter face 212 into the putter head 200, and the upper wall surface 254 may extend substantially perpendicular to the putter face 212 into the putter head 200. The first set of grooves 220 may exhibit a gradual change in the incline angle or pitch of the lower wall surfaces 252 along the vertical profile of the putter face 212, while the angle or pitch of the upper wall surfaces 254 may be substantially the same. In other words, each lower wall surface 252 may have a unique pitch that differs by a delta amount from adjacent lower wall surfaces 252. In some arrangements, the pitch of adjacent lower wall surfaces 252 may differ by a delta amount of about 5 degrees. The delta amount may vary depending on the putter. In FIG. 12, a lowermost groove 250*a* of the first set of grooves 220 includes a lower wall surface 252*a* having a first inclined pitch, an uppermost groove 250*b* of the first set of grooves 220 includes a lower wall surface 252*b* having a second inclined pitch that is less than the first inclined pitch, and the lower wall surfaces 252 of the grooves 250 located between the lowermost groove 250*a* and the uppermost groove 250*b* gradually decrease in their inclined pitch from the lowermost groove 250*a* to the uppermost groove 250*b* along the vertical profile of the putter face 212.

Referring still to FIG. 12, each groove 260 of the third set of grooves 226 may have a non-symmetrical cross-sectional configuration or shape. In FIG. 12, each groove 260 of the third set of grooves 226 may extend downwardly into the putter head 200. Each groove 260 may be defined by an upper or first wall surface 262 and a lower or second wall surface 264, which may intersect each other to define a bottom or vertex 265 of the respective groove 260. The upper wall surface 262 may extend at a decline angle or pitch from the putter face 212 into the putter head 200, and the lower wall surface 264 may extend substantially perpendicular to the putter face 212 into the putter head 200. The third set of grooves 226 may exhibit a gradual change in the decline angle or pitch of the upper wall surfaces 262 along the vertical profile of the putter face 212, while the angle or pitch of the lower wall surfaces 264 may be substantially the same. In other words, each upper wall surface 262 may have a unique pitch that differs by a delta amount from adjacent upper wall surfaces 262. In some arrangements, the pitch of adjacent upper wall surfaces 262 may differ by a delta amount of about 5 degrees. The delta amount may vary depending on the putter. In FIG. 12, a lowermost groove 260*a* of the third set of grooves 226 includes an upper wall surface 262*a* having a first declined pitch, an uppermost groove 260*b* includes an upper wall surface 262*b* having a second declined pitch that is greater than the first declined pitch, and the upper wall surfaces 262 of the grooves 260 located between the lowermost groove 260*a* and the uppermost groove 260*b* gradually increase in their declined pitch from the lowermost groove 260*a* to the uppermost groove 260*b* along the vertical profile of the putter face 212.

With continued reference to FIG. 12, the second set of grooves 222 generally is located at the center of the putter face 212 near the vertical center of gravity (center of mass) of the putter head 200, where the ball is ideally struck. In FIG. 12, a single groove 238 is included in the second set of grooves 222, although more than one groove may be included in the second set of grooves 222. The one or more grooves of the second set of grooves 222 may be located near the center of the putter face 212 and may include upper and lower wall surfaces oriented substantially perpendicular to the putter face 212, as illustrated in FIG. 12. The upper and lower wall surfaces may be connected together by a substantially flat surface located at a bottom of the respective groove and oriented substantially parallel to the putter face 212, as illustrated in FIG. 12.

Referring to FIG. 13, the groove pattern 316 includes a first set, region, or zone of grooves 320 (hereinafter "first set of grooves" for the sake of convenience without intent to limit), a second set, region, or zone of grooves 322 (hereinafter "second set of grooves" for the sake of convenience without intent to limit), and a third set, region, or zone of grooves 326 (hereinafter "third set of grooves" for the sake of convenience without intent to limit). In FIG. 13, the first set of grooves 320 includes seven grooves formed in the putter face 312, the second set of grooves 322 includes a single groove formed in the putter face 312, and the third set of grooves 326 includes seven grooves formed in the putter face 312. It should be understood that the first set of grooves 320, the second set of grooves 322, and the third set of grooves 326 may include more or less than the grooves illustrated in FIG. 13. The first set of grooves 320 may extend at an incline from the putter face 312 into the putter head 300, and the third set of grooves 326 may extend at a decline from the putter face 312 into the putter head 300. The groove pattern 316 may exhibit a gradual change in the pitch of the groove angles in the first set of grooves 320 and the third set of grooves 326 along the vertical profile of the putter face 312. Each groove in the first set of grooves 320 and in the third set of grooves 326 may have a unique pitch. The pitch of adjacent grooves in the first set of grooves 320 and in the third set of grooves 326 along the vertical profile of the putter face 312 may differ by a delta amount, such as about 5 degrees. The delta amount may vary depending on the putter.

Referring still to FIG. 13, each groove 350 of the first set of grooves 320 may have a non-symmetrical cross-sectional configuration or shape. In FIG. 13, each groove 350 may extend upwardly into the putter head 300. Each groove 350 may be defined by a lower or first wall surface 352 and an upper or second wall surface 354, which may intersect each other to define a bottom or vertex 355 of the respective groove 350. The lower wall surface 352 may extend at an incline angle or pitch from the putter face 312 into the putter head 300, and the upper wall surface 354 may extend substantially perpendicular to the putter face 312 into the putter head 300. The first set of grooves 320 may exhibit a gradual change in the incline angle or pitch of the lower wall surfaces 352 along the vertical profile of the putter face 312, while the angle or pitch of the upper wall surfaces 354 may be substantially the same. In other words, each lower wall surface 352 may have a unique pitch that differs by a delta amount from adjacent lower wall surfaces 352. In some arrangements, the pitch of adjacent lower wall surfaces 352 may differ by a delta amount of about 5 degrees. The delta amount may vary depending on the putter. In FIG. 13, a lowermost groove 350*a* of the first set of grooves 320 includes a lower wall surface 352*a* having a first inclined pitch, an uppermost groove 350*b* of the first set of grooves 320 includes a lower wall surface 352*b* having a second inclined pitch that is greater than the first inclined pitch, and the lower wall surfaces 352 of the grooves 350 located between the lowermost groove 350*a* and the uppermost groove 350*b* gradually increase in their inclined pitch from the lowermost groove 350*a* to the uppermost groove 350*b* along the vertical profile of the putter face 312.

Referring still to FIG. 13, each groove 360 of the third set of grooves 326 may have a non-symmetrical cross-sectional configuration or shape. In FIG. 13, each groove 360 of the third set of grooves 326 may extend downwardly into the putter head 300. Each groove 360 may be defined by an upper or first wall surface 362 and a lower or second wall surface 364, which may intersect each other to define a bottom or vertex 365 of the respective groove 360. The upper wall surface 362 may extend at a decline angle or pitch from the putter face 312 into the putter head 300, and the lower wall surface 364 may extend substantially perpendicular to the putter face 312 into the putter head 300. The third set of grooves 326 may exhibit a gradual change in the decline angle or pitch of the upper wall surfaces 362 along the vertical profile of the putter face 312, while the angle or pitch of the lower wall surfaces 364 may be substantially the same. In other words, each upper wall surface 362 may have a unique pitch that differs by a delta amount from adjacent upper wall surfaces 362. In some arrangements, the pitch of adjacent upper wall surfaces 362 may differ by a delta amount of about 5 degrees. The delta amount may vary depending on the putter. In FIG. 13, a lowermost groove 360*a* of the third set of grooves 326 includes an upper wall surface 362*a* having a first declined pitch, an uppermost groove 360*b* includes an upper wall surface 362*b* having a second declined pitch that is less than the first declined pitch, and the upper wall surfaces 362 of the grooves 360 located between the lowermost groove 360*a* and the uppermost groove 360*b* gradually decrease in their declined pitch from the lowermost groove 360*a* to the uppermost groove 360*b* along the vertical profile of the putter face 312.

With continued reference to FIG. 13, the second set of grooves 322 generally is located at the center of the putter face 312 near the vertical center of gravity (center of mass) of the putter head 300, where the ball is ideally struck. In FIG. 13, a single groove 338 is included in the second set of grooves 322, although more than one groove may be included in the second set of grooves 322. The one or more grooves of the second set of grooves 322 may be located near the center of the putter face 312 and may include upper and lower wall surfaces oriented substantially perpendicular to the putter face 312, as illustrated in FIG. 13. The upper and lower wall surfaces may be connected together by a substantially flat surface located at a bottom of the respective groove and oriented substantially parallel to the putter face 312, as illustrated in FIG. 13.

Referring to FIGS. 12 and 13, the depth of the grooves d1, d2, d3 in the first set of grooves 220, 320 and the third set of grooves 226, 326 may change along the vertical profile of the putter face 212, 312, because the pitch or pitch angles of the respective grooves change along the vertical profile of the putter face 212, 312. The groove pattern 216 of FIG. 12 includes deeper grooves in the first set of grooves 220 and the third set of grooves 226 near the center of the putter face 212 adjacent the second set of grooves 222. In contrast, the groove pattern 316 of FIG. 13 includes deeper grooves in the first set of grooves 320 and the third set of grooves 326 near the top and bottom of the putter face 312 distal to the second set of grooves 322. The grooves of the first set of grooves 220, 320 are separated from one another by intermediate surfaces 246, 346 that are coplanar with the putter face.

With continued reference to FIGS. 12 and 13, the gradual pitch change in the groove patterns 216 and 316 along the vertical profile of the putter faces 212 and 312, respectively, influences the amount the groove edges interact with the surface of the ball. The amount of interaction required to influence ball roll performance diminishes the closer the ball is struck to the center of mass of the putter head because, as previously described, a ball that is struck near the center of mass of the putter head generally achieves forward roll in an efficient manner based on the static loft angle of the putter face. The groove patterns 216 and 316 generally create a modulated groove effect depending on how far off-center the ball is struck along the face 212, 312 of the putter head 200, 300, respectively. The more vertically off-center the ball is struck along the face 212, 312 of the putter head 200, 300, the more influence the groove patterns 216 and 316 impart on the ball to compensate for the misalignment of the ball's center of mass with the putter's center of mass.

The foregoing description has broad application. It should be appreciated that the concepts disclosed herein may apply to many different styles and types of putters, in addition to the putter described and depicted herein. The discussion of any embodiment is meant only to be explanatory and is not intended to suggest that the scope of the disclosure, including the claims, is limited to these embodiments. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, the preceding discussion refers to first, second, and third sets of grooves. The first, second, and third identifiers are used in the preceding discussion to distinguish one set of grooves from another for convenience purposes. In the following claims, the first, second, and third identifiers may be used to refer to any one of the sets of grooves previously described. As another example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

The phrases "at least one", "one or more", and "and/or", as used herein, are open-ended expressions that are both conjunctive and disjunctive in operation. The term "a" or "an" entity, as used herein, refers to one or more of that entity. As such, the terms "a" (or "an"), "one or more" and "at least one" can be used interchangeably herein. All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

What is claimed is:

1. A putter head comprising:

a putter face defining:

a first set of grooves located in an upper region or a lower region of the putter face and including multiple vertically-adjacent grooves extending in a heel-to-toe direction of the putter face, each groove of the first set of grooves having a non-symmetrical cross-sectional configuration in a vertical profile dirction of the putter face uniformly along its entire length in the heel-to-toe direction and having a constant depth in the heel-to-toe direction; and a second set of grooves located in a middle region of the putter face, the second set of grooves including one or more grooves extending in the heel-to-toe directon of the putter face, each groove of the second set of grooves having a symmetrical cross-sectional configuration in the vertical profile direction uniformly along its entire length in the heel-to-toe direction and having a constant depth in the heel-to-toe direction;

wherein respective depths of the non-symmetrical cross-sectional configurations of the grooves of the first set of grooves vary in the vertical profile direction between a lowermost groove and an uppermost groove in the first set of grooves to provide a varying launch angle along the vertical profile direction of the first set of grooves;

wherein each groove of the first set of grooves includes an upper wall surface and a lower wall surface;

one of the upper wall surfaces or the lower wall surfaces extends inwardly into the putter head at an angle with respect to the vertical profile direction of the putter face that is different compared to the upper wall surfaces or lower wall surfaces of the other grooves in the first set of groove; and the other of the upper wall surfaces or the lower wall surfaces extends inwardly into the putter head at a same angle as the uppper wall surfaces or lower wall surfaces of the other grooves in the first set of grooves along the vertical profile direction of the putter face; and wherein the first set of grooves is located in the lower region of the putter face;

each of the upper wall surfaces extends inwardly into the putter head at the same angle along the veretical profile of the putter face; and the lower wall surfaces extend inwardly and upwardly into the putter head at respective angles that either increase or decrease along the vertical profile direction of the putter face.

2. The putter head according to claim 1, wherein each groove of the second set of grooves comprises a square groove.

3. The putter head according to claim 1, wherein the grooves of the first set of grooves are separated from one another by intermediate surfaces that are coplanar with the putter face.

4. The putter head according to claim 1, wherein a depth of the grooves of the first set of grooves increases along the vertical profile direction of the putter face.

5. The putter head according to claim 1, wherein each groove of the first set of grooves has a different depth.

6. The putter head according to claim 1, wherein the upper wall surfaces and the lower wall surfaces intersect at a bottom of the respective grooves.

7. The putter head according to claim 1, wherein the upper wall surfaces extend perpendicular to the putter face.

8. A putter head comprising:

a putter face defining:

a first set of grooves located in an upper region or a lower region of the putter face and including multiple vertically-adjacent grooves extending in a heel-to-toe direction of the putter face, each groove of the firt set of grooves having a non-symmetrical cross-sectional configuration in a vertical profile direction of the putter face uniformly along its entire length in the heel-to-toe direction and having a constant depth in the heel-to-toe direction; and a second set of grooves located in a middle region of the putter face, the second set of grooves including one or more grooves extending in the heel-to-toe direction of the putter face, each groove of the second set of grooves having a symmetrical cross-sectional configuration in the vertical profile direction uniformly along its entire length in the heel-to-toe direction and having a constant depth in the heel-to-toe direction:

wherein respective depths of the non-symmetrical cross-sectional configurations of the grooves of the first set of grooves vary in the vertical profile diretion between a lowermost groove and an uppermost groove in the first set of grooves to provide a varying launch angle along the vertical profile direction of the first set of grooves:

wherein each groove of the first set of grooves includes an upper wall surface and a lower wall surface:

one of the upper wall surfaces or the lower wall surfaces extends inwardly into the putter head at an angle with respect to the vertical profile direction of the putter face that is different compared to the upper wall surfaces or lower wall surfaces of the other grooves in the first set of grooves; and the other of the upper wall surfaces or the lower wall surfaces extends inwardly into the putter head at a same angle as the upper wall surfaces or lower wall surfaces of the other grooves in the first set of grooves along the vertical profile direction of the putter face; and wherein the first set of grooves is located in the upper region of the putter face;

the upper wall surfaces extend inwardly and downwardly into the putter head at respective angles that either increase or decrease along the vertical profile direction of the putter face; and each of the lower wall surfaces extends inwardly into the putter head at the same angle along the vertical profile direction of the putter face.

9. The putter head according to claim 8, wherein each groove of the second set of grooves is defined by an upper wall surface and a lower wall surface that each extend inwardly into the putter head and are connected together by a substantially flat surface located at a bottom of the groove.

10. The putter head according to claim 8, wherein the respective depths of the grooves of the first set of grooves decrease along the vertical profile direction of the putter face.

11. The putter head according to claim 8, wherein the lower wall surfaces extend substantially perpendicular to the putter face.

12. A putter head comprising:

a putter face defining:

a first set of grooves located in an upper region or a lower region of the putter face and including multiple vertically-adjacent groove extending in a heel-to-toe direction of the putter face, each groove of the first set of grooves having a non-symmetrical cross-sectional configuration in a vertical profile direction of the putter face uniformly along its entire length in the heel-to-toe direction and having a constant depth in the heel-to-toe direction; and a second set of grooves located in a middle region of the putter face, the second set of grooves including one or more grooves extending in the heel-to-toe direction of the putter face, each groove of the second set of grooves having a symmetrial corss-sectional configuration in the vertical profile direction uniformly along its entire lenght in the heel-to-toe direction and having a constant depth in the heel-to-toe direction;

wherein respective depths of the non-symmetrical cross-sectional configurations of the grooves of the first set of grooves vary in the vertical profile direction between a lowermost groove and an uppermost groove in the first set of grooves to provide a varying launch angle along the vertical profile direction of the first set of grooves:

wherein the first set of grooves is located in the lower region of the putter face;

wherein the putter head further comprises a third set of grooves located in the upper region of the putter face;

wherein the third set of grooves includes multiple vertically-adjacent grooves extending the the heel-to-toe direction of the putter face, each groove of the third set of grooves having a non-symmetrical cross-sectional configuration in the vertical profile direction along its entire length in the heel-to-toe direction and having a constant depth in the heel-to-toe direction;

wherein respective depths of the non-symmetrical cross-sectional configurations of the groove of the third set of grooves vary in the vertical profile direction between a lowermost groove and an uppermosst groove to provide a varying launch angle along the vertical profile direction of the third set of grooves; and wherein each groove of the first set of grooves includes an upper wall surface and a lower wall surface;

the upper wall surfaces of the grooves of the first set of grooves extend perpendicular to the putter face;

the lower wall surfaces of the grooves of the first set of grooves extend inwardly and upwardly into the putter head at respective angles that either increase or decrease along the vertical profile direction of the putter face;

each groove of the third set of grooves includes an upper wall surface and a lower wall surgace;

the upper wall surfaces of the grooves of the third set of grooves extend inwardly and downwardly into the putter head at respective angles that either increase or decrease along the vertical profile direction of the putter face; and the lower wall surfaces of the grooves of the third set of grooves extend perpendicular to the putter face.

13. The putter head according to claim 12, wherein the depths of the grooves of the first set of grooves and the depths of the grooves of the third set of grooves increase as each of the first set of grooves and the third set of grooves approaches the second set of grooves.

14. The putter head according to claim 12, wherein the depths of the grooves of the first set of grooves and the depths of the grooves of the third set of grooves decrease as each of the first set of grooves and the third set of grooves approaches the second set of grooves.

* * * * *